United States Patent [19]

Christie

[11] Patent Number: 4,832,188

[45] Date of Patent: May 23, 1989

[54] FLEXIBLE FILM PACKAGE FOR CARRY-OUT MEAL ITEMS

[76] Inventor: Eugene P. Christie, 543 Granville Ave., Hillside, Ill. 60162

[21] Appl. No.: 787,309

[22] Filed: Oct. 15, 1985

[51] Int. Cl.[4] ..... B65D 81/24

[52] U.S. Cl. ..... 206/162; 206/139; 383/106; 383/109; 383/127

[58] Field of Search ..... 383/103, 109, 114, 101, 383/127, 106; 206/162, 139

[56] References Cited

U.S. PATENT DOCUMENTS

| | | | |
|---|---|---|---|
| 1,158,349 | 10/1915 | Witalen | 383/127 |
| 1,628,718 | 5/1927 | Fritzsche | 383/127 |
| 2,344,369 | 3/1944 | Salfisberg | 383/109 |
| 3,543,999 | 12/1970 | Kugler | 383/189 |

*Primary Examiner*—Joseph Man-Fu Moy

*Attorney, Agent, or Firm*—Fitch, Even, Tabin & Flannery

[57] ABSTRACT

A flexible film package for carry-out meal items is fabricated from a pair of telescoped sack members, the outer sack member being made longer than the inner sack member in order to define a spill-confinement pouch in its bottom and the inner sack member being fabricated from relatively stiffer film material than the outer sack member and with one or more beverage cup receiving apertures in its bottom for promoting a stable, upright positioning of the beverage cups during carrying of the filled package and upon placement of the filled package on a generally horizontal support surface.

9 Claims, 2 Drawing Sheets

FLEXIBLE FILM PACKAGE FOR CARRY-OUT MEAL ITEMS

FIELD OF THE INVENTION

This invention relates generally to the packaging arts and more particularly to inexpensive bags for use in assembling the individually containerized food items of a carry-out meal.

BACKGROUND OF THE INVENTION

The typical carry-out meal consists of three items: a sandwich product that has been packaged in a clamshell-type, foamed plastic enclosure; a beverage contained in a plastic-coated paper cup with a plastic lid; and french fries jumbled into a small, open-top paper sack. According to usual practice in fast-food restaurants, a selection of these items is collected in a suitably sized paper bag for delivery to the customer. The paper bag is itself specifically arranged to have an oblong or rectangular bottom so that the beverage cups can be placed into the bag first with reasonable assurance of staying upright and avoiding spillage after insertion of the remaining items and until consumption of the food is begun.

A common problem with purveying this sort of meal resides in a leakage or spillage of the beverage causing disintegration of the paper bag and scattering of its contents with attendant mess. Despite the notoriously low wet-strength of paper, wetproof plastic film bags have not replaced paper bags for carry-out meals because, heretofore, plastic film bags could not be economically fashioned with flat bottoms or with other means for affording a stable, upright positioning of the beverage cups.

Accordingly, a general object of the present invention is to provide a new and improved flexible film sack for the packaged items of a carry-out meal.

Another general object of the invention is to provide a low-cost, wetproof sack for carry-out meal items.

Still another object of the invention is to provide a flexible, plastic film sack with a stabilizing structure for beverage cups and with a spill-confinement reservoir.

These and other objects and features of the invention will become apparent from a consideration of the following descriptions.

BRIEF DESCRIPTION OF THE INVENTION

The present invention overcomes the limitations of the prior art by fabricating a sack from polyethylene film or the like and by constructing the sack from a pair of telescoped sack members, the outer sack member being made longer than the inner sack member whereby to define a spill-confinement pouch or reservoir in its bottom and the inner sack member being fashioned of relatively stiffer film material and with one or more beverage cup receiving apertures in its bottom whereby to promote a stable, upright positioning of the beverage cups during carrying and upon placement of the filled sack on a generally horizontal support surface.

BRIEF DESCRIPTION OF THE DRAWINGS

In order that the principles of the invention may be readily understood, a single embodiment thereof, applied to a wetproof sack which is configurated for the residence of two beverage cups, but to which the application is not to be restricted, is shown in the accompanying drawings wherein.

DETAILED DESCRIPTION OF THE INVENTION

Figure 1:
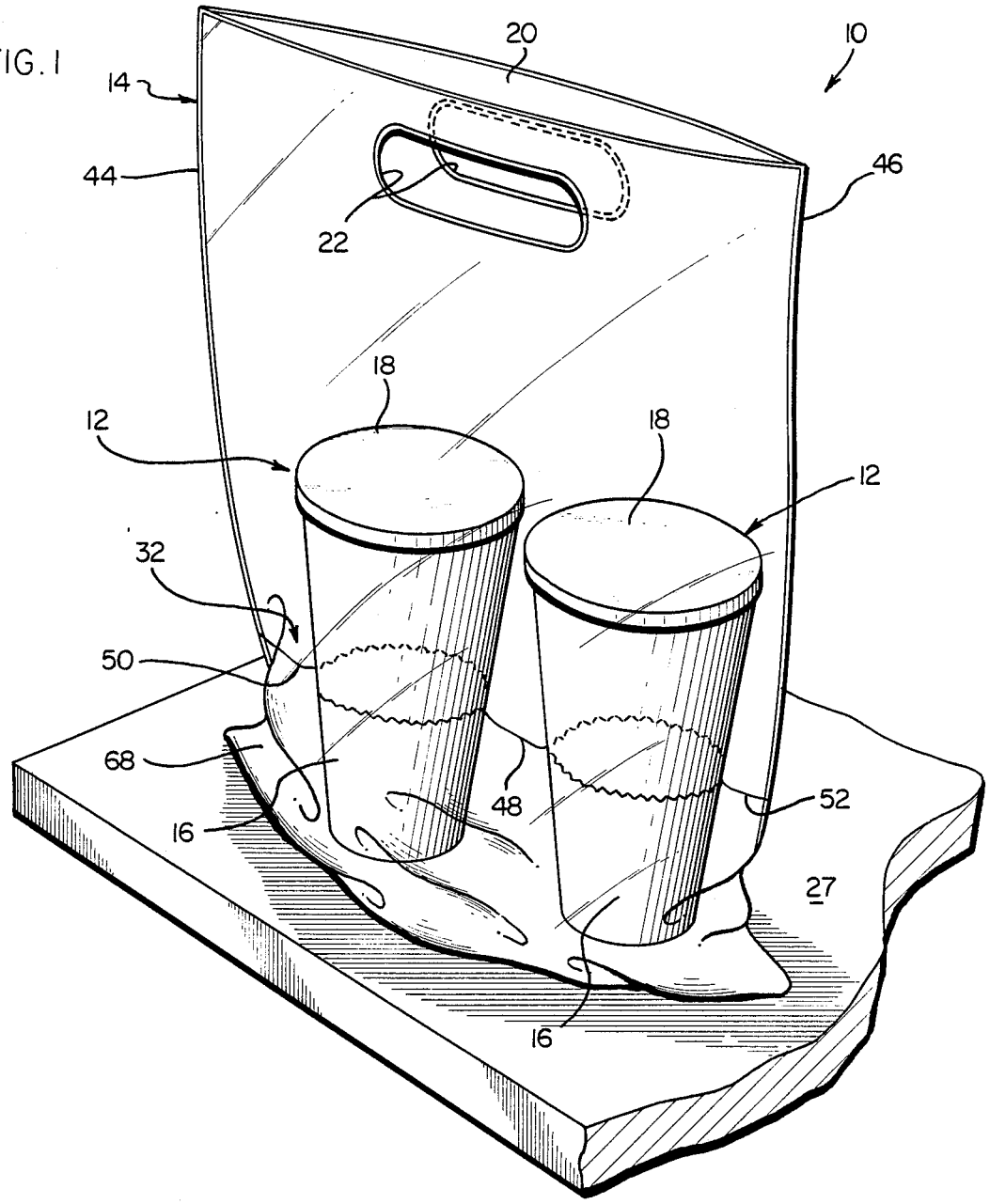
FIG. 1 is a perspective view of a fast-food package assembly comprising a flexible plastic film sack and two beverage container units.

Referring now in detail to the drawings and giving first consideration to FIG. 1, a fast-food package assembly indicated generally by the reference numeral 10 includes a suitable number of beverage container units 12 and a flexible, translucent plastic film sack 14 that is constructed in compliance with the present invention for use in assembling and carrying the beverage container units 12 and complementary, packaged, menu items. In compliance with conventional practice, each of the beverage container units 12 includes an inverted frusto-conical cup 16 fabricated, for example, from paper which has been lightly coated with paraffin wax or a polyethylene resin, and a snap-fit plastic lid or closure 18.

The sack 14 is fabricated with an open top end 20 for convenience in use, and with aligned, ovate hand-hold apertures 22 which are defined by encircling fusion seams and which are situated adjacent the top end 20 for facilitating manual transportation. In addition and as will be described more fully hereinafter, the sack 14 includes special provision for the upright positioning of the beverage container units 12 in a spaced-apart relationship; and in addition, the sack 14 is specifically dimensioned to possess sufficient volume or capacity generally above the beverage container units 12 to receive additional, packaged meal items on top of the lids 18. This space is provided to receive such things as clamshell-type sandwich containers, packaged condiments, individual-serving sized bags of french fried potatoes or potatoe chips, and the like.

Figure 3:
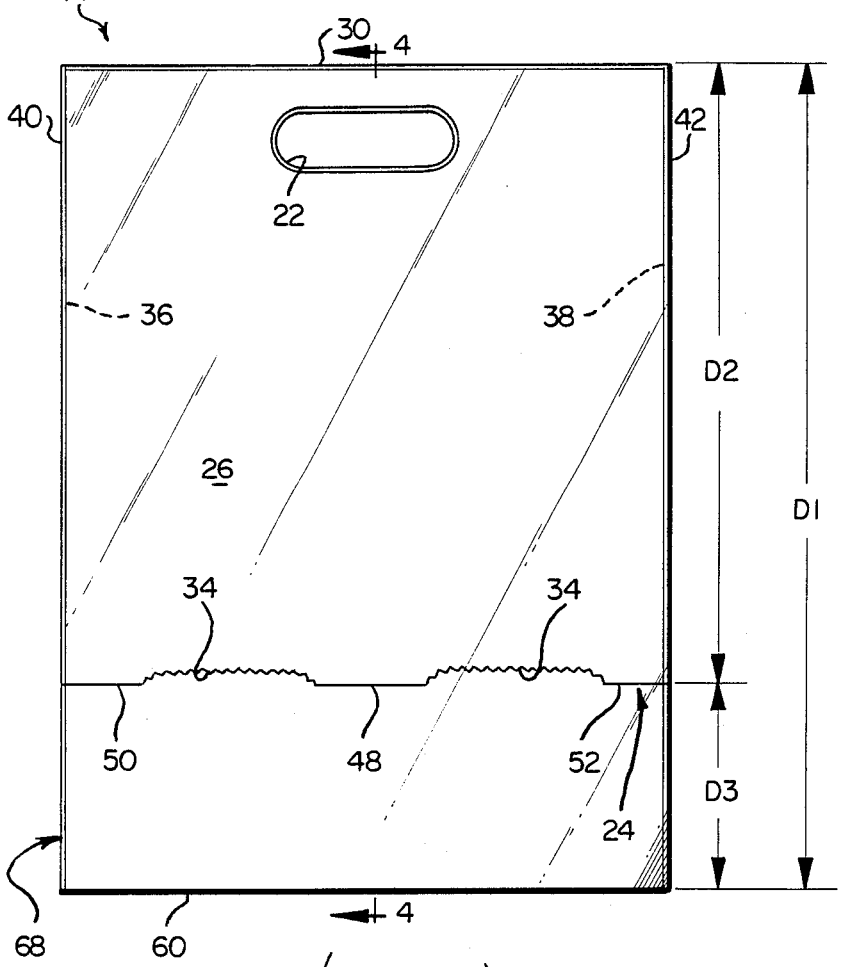
FIG. 3 is a side elevational view of the flexible film sack of FIG. 1, shown flattened as it would appear prior to use.
Figure 4:
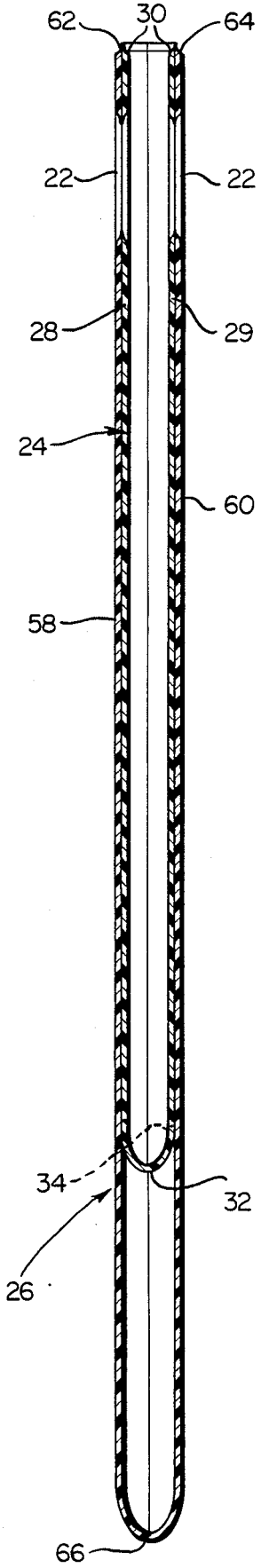
FIG. 4 is a sectional view taken substantially along the Line 4—4 of FIG. 3 to show certain details of the construction of the sack.

Turning to FIGS. 3 and 4, the sack 14 comprises a first, inner, flattened tubular sack member 24 and a second, outer, flattened tubular sack member 26 which is generally telescoped over the first sack member 24 and interconnected therewith. The individual sack members 24 and 26 are fabricated from blown, extruded or cast film of low density, linear polyethylene resin, for example; and in one useful embodiment of the invention, the film for the inner sack member 24 is selected to be two mils thick and the film for the outer sack member 26 is cooperatively selected to be one-and-one-half mils thick. With the film material for the inner and outer sack member so selected, the inner sack member exhibits generally greater stiffness than the outer sack member whereby to promote lateral support of the beverage container units 12; and cooperatively, the outer sack member exhibits considerable flexibility and minimal interference with placement of the package assembly 10 in an upright position on a generally horizontal support surface 27, as is shown in FIG. 1.

Continuing with reference to FIGS. 3 and 4, the inner sack member 24 comprises generally aligned, confronting front and back panels 28 and 29 which terminate in respective top edges 30, top edges 30 cooperating to define the open top end 20 of the sack 14. The inner sack member 24 further comprises a bottom edge 32 which is advantageously made of seamless construction, as by being comprised of a folded section of the film, the sack member 24 additionally incorporating suitably shaped, bottom, cup-receiving apertures 34 which are punched or die-cut out of the material of sack 24 adjacent the bottom edge 32. The inner sack member 24 also comprises pairs of spaced side edges 36 and 38 which are joined together with each other and together with the corresponding, adjacent side edge portions 40 and 42 of the cooperating outer sack member 26, forming four-ply, fusion side seams 44 and 46, shown in FIG. 2.

Figure 2:
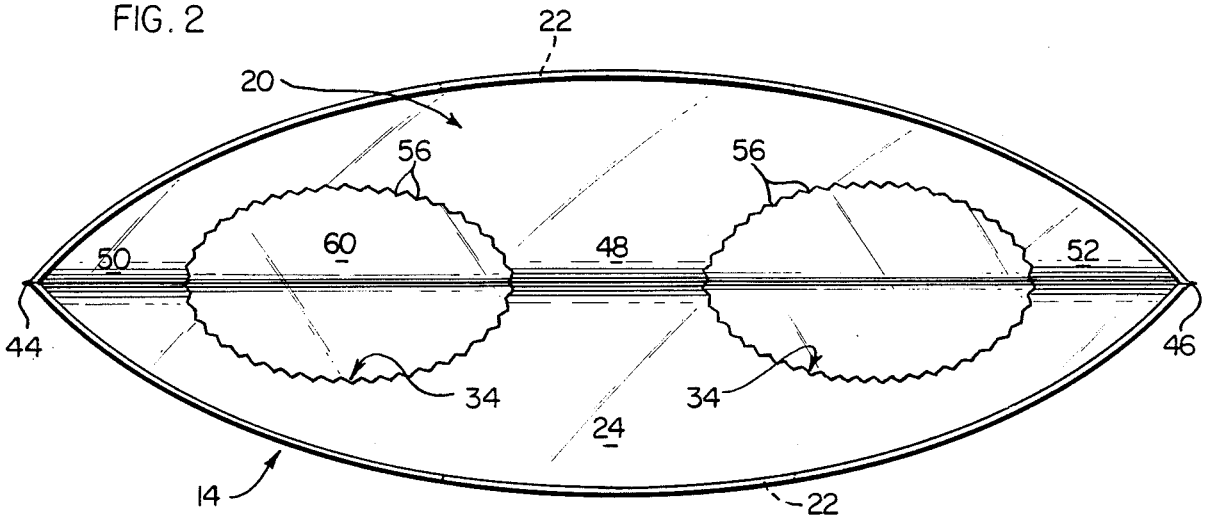
FIG. 2 is an enlarged, top plan view looking into the open upper end of the sack of FIG. 1 but showing the beverage container units removed.

In compliance with the principles of the present invention, the cup apertures 34 are separated from each other by a first, medial spacer edge portion 48 and from the respective side seams 44 and 46 by second and third, outboard spacer edge portions 50 and 52. More specifically, the spacer edge portions 48, 50 and 52 are dimensioned so as to position the beverage container units 12 in closely spaced-apart relationship with respect to each other and with respect to the side seams 44 and 46, as is suggested in FIG. 1, whereby to promote free-standing capabilities. Moreover, the margins of cup apertures 34 are serrated with dentate formations 56, as is shown in FIG. 2, in order to enhance the gripped engagement between the apertures 34 and the side walls of the cups 16.

Returning to FIGS. 3 and 4, the outer sack member 26 includes generally aligned, confronting front and back panels 58 and 60 which terminate in respective top edges 62 and 64 and which merge into a common bottom edge 66. The bottom edge 66 is advantageously made of seamless construction, as by being comprised of a folded section of the film, in order to obviate the bottom ends of beverage cups 16 from resting on a de-stabilizing bump or seam, which would tend to tip the cup, when placed on a horizontal support surface. The top edges 62 and 64 of the panels 58 and 60 are connected respectively to the immediately adjacent top edge 30 of inner sack member 24 with fusion joints therebetween, thus forming separate top edge seams for defining the open top end 20 of the sack 14.

Figure 5:
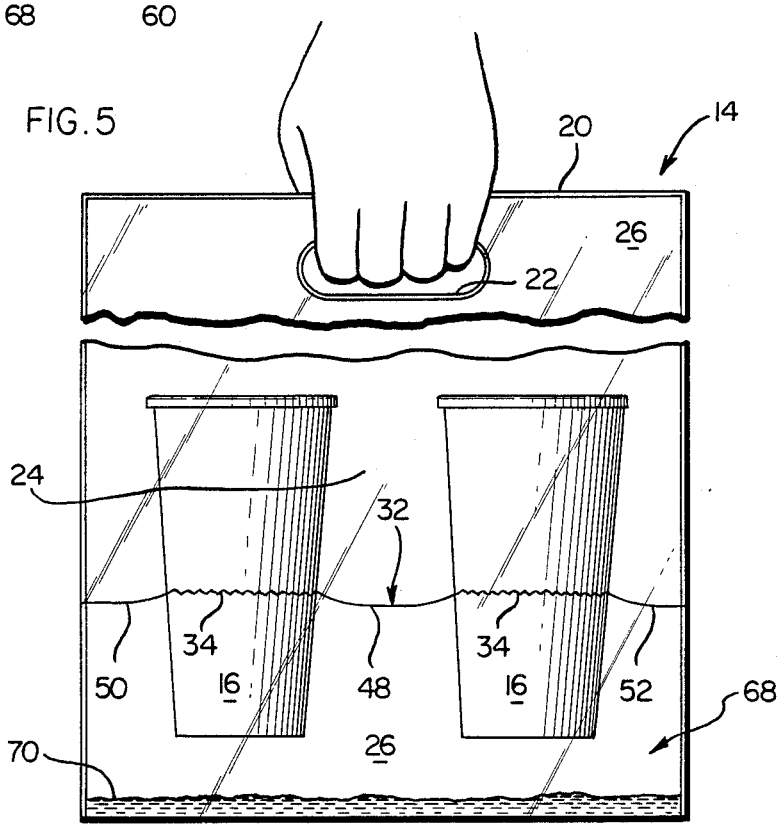
FIG. 5 is an elevational view in partial section, showing the package assembly of FIG. 1 in the transportation or carrying mode.

In compliance with the principles of the present invention, the outer sack member 26 is fabricated with a length or depth D1 which is greater than the length or depth D2 of the inner sack member 24 in order to define a spill-confinement pouch or reservoir 68 of depth D3 generally beneath the cup apertures 34 and the inner sack member bottom edge 32. In use of the sack 14, should tipping of the sack or dislodgement of the cup lids 18 result in spillage of the beverage liquid, lifting of the upper end of the sack 14 by means of the hand-hold apertures 22 would cause any spilled liquid to run down the panels of inner sack 24 and drain through the cup apertures 34 away from the other food packages and into the reservoir 68, as is suggested at 70 in FIG. 5. The components of sack 14, being of wetproof plastic film, are able to safely contain such spilled liquid, or any condensate, away from the other food packages and generally out of contact with the bottoms of the cups 16. The translucency of the plastic film material also allows visual discrimination and selection between light colored and dark colored beverage liquids in the respective container units 12, as an aid in serving the fast-food meal.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated in the following claims.

The invention is claimed as follows:

1. A sack for assembling and carrying packaged food items including a beverage cup, comprising:

a first flexible film sack member having spaced top edges defining an open top and having a bottom which includes an aperture sized to receive an inverted frustro-conical beverage cup at a mid-region thereof in gripping engagement therewith; and a second open-top, flexible film sack member telescoped over said first sack member and having spaced top edges aligned with and sealed to the respective top edges of said first sack member, said second sack member being of greater length than said first sack member whereby to define a spill-confinement reservoir beneath said aperture.

2. A sack according to claim 1 wherein said first and second sack members include respective pairs of aligned hand-hold apertures disposed adjacent the top edges thereof, said sack members including fusion connection means joining the respective next adjacent surfaces of said first and second sack members surrounding said hand-hold apertures whereby to form cooperative carrying handle elements.

3. A sack according to claim 1 wherein the film of said first sack member is of greater stiffness than the film of said second sack member whereby to promote lateral support of said beverage cup.

4. A sack according to claim 1 wherein said aperture includes serrated gripping edge means.

5. A sack according to claim 1 wherein said first sack member includes a second bottom aperture and wherein said bottom further includes spacer panel elements separating said apertures from each other and from the sides of said sack.

6. A sack according to claim 1 wherein said second sack member includes a seamless bottom.

7. A package assembly comprising: a beverage container unit including an inverted frusto-conical cup and a lid for closing the top of said cup; a sack for assembling and carrying packaged food items including said beverage container unit, said sack including a first sack member having spaced top edges defining an open top and having a bottom aperture grippingly receiving said cup at a mid-region thereof, and a second open-top sack member telescoped over said first sack member and having spaced top edges aligned with and sealed to the respective top edges of said first sack member, said second sack member being of greater length than said first sack member whereby to define a spill-confinement reservoir beneath said cup.

8. A package assembly according to claim 1 wherein said second sack member is of comparatively light guage material and includes a bottom edge spaced apart from the bottom of said cup whereby to minimize interference with stable placement of said cup in an upright position on a generally horizontal support surface.

9. A package assembly according to claim 1 wherein said second sack member includes a seamless bottom.

* * * * *